US005398343A

United States Patent [19]

Kuracina

[11] Patent Number: 5,398,343

[45] Date of Patent: Mar. 21, 1995

[54] VENTILATING SHIRT WITH CIRCUMFERENTIALLY FOLDED AND FASTENED PORTION

[76] Inventor: Thomas C. Kuracina, 329 Gridley Rd., Ojai, Calif. 93023

[21] Appl. No.: 85,412

[22] Filed: Jul. 1, 1993

[51] Int. Cl.[6] ..... A41B 1/00

[52] U.S. Cl. ..... 2/115; 2/269; 2/DIG. 1; 2/106; 40/586

[58] Field of Search ..... 2/115, 114, DIG. 1, 2/DIG. 7, 106, 108, 269; 40/586

[56] References Cited

U.S. PATENT DOCUMENTS

| | | | |
|---|---|---|---|
| 4,985,936 | 1/1991 | Jones | 2/269 |
| 4,991,233 | 2/1991 | Hall | 2/115 |
| 4,995,115 | 2/1991 | Ellis | 2/114 |
| 4,996,723 | 3/1991 | Huhn et al. | 2/DIG. 1 |
| 4,999,848 | 3/1991 | Oney | 2/115 |
| 5,299,323 | 4/1994 | Schaefer et al. | 2/269 |

*Primary Examiner*—Andrew M. Falik
*Assistant Examiner*—Gloria Hale
*Attorney, Agent, or Firm*—Donald A. Streck

[57] ABSTRACT

A torso-covering tube garment capable of selectively fully-covering or partially-covering the lower torso of a wearer. There is a torso-covering tube garment of a foldable material having a bottom portion covering the wearer's torso and fasteners for releasably holding the lower portion of the bottom portion against its upper portion to expose the wearer's torso for ventilating. In one version, the bottom portion folds over upon itself in thirds and exposes an outer surface of a bottom one third of the bottom portion when in the raised position and a message is on the outer surface of the bottom one third of the bottom portion whereby the message is visible when the bottom portion is in the raised position and the lowered position. In another version, the bottom portion is folded over upon itself in half and exposes an inner surface of a bottom one half of the bottom portion when in the raised position and the message is on the inner surface of the bottom one half of the bottom portion whereby the message is a hidden message only visible when the bottom portion is in the raised position.

11 Claims, 6 Drawing Sheets

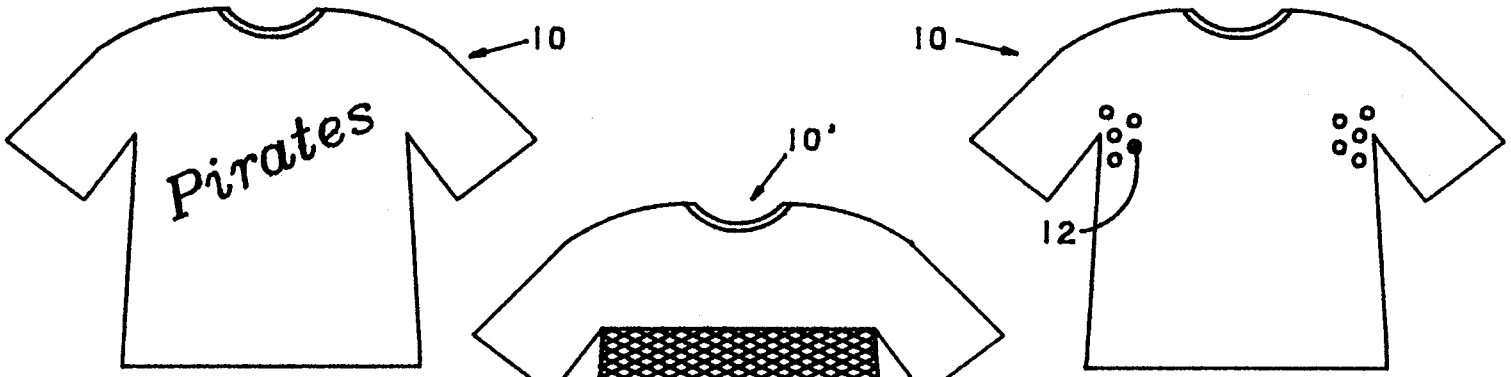
PRIOR ART
FIG. 1
PRIOR ART
FIG. 2
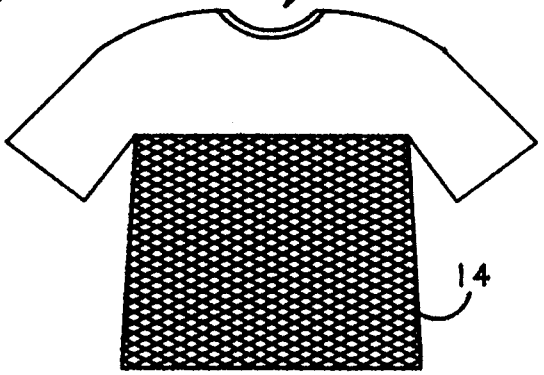
PRIOR ART
FIG. 3
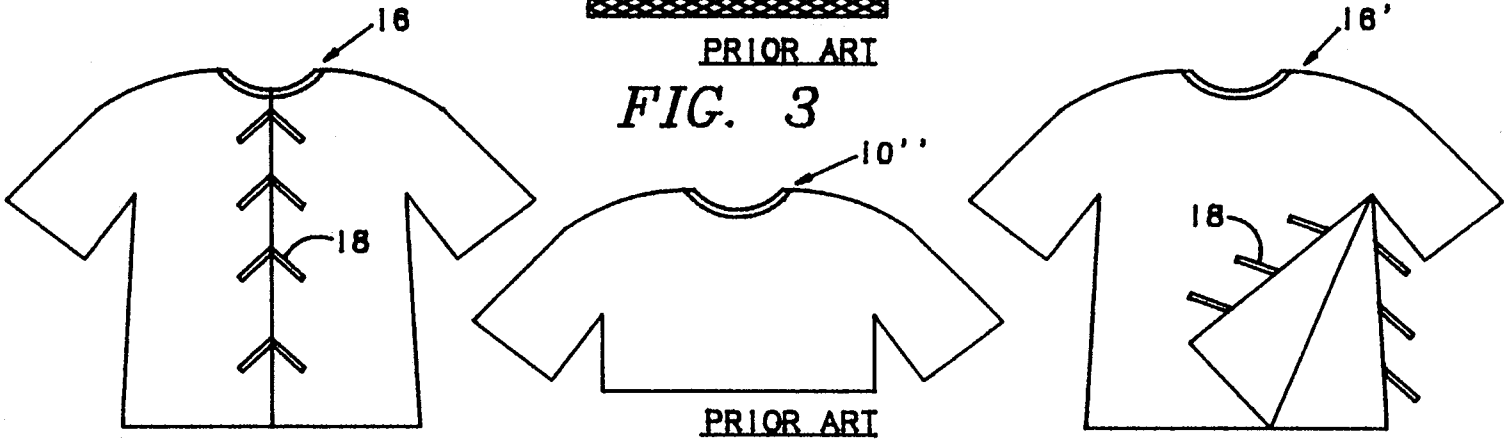
PRIOR ART
FIG. 4
PRIOR ART
FIG. 5
PRIOR ART
FIG. 6

VENTILATING SHIRT WITH CIRCUMFERENTIALLY FOLDED AND FASTENED PORTION

BACKGROUND OF THE INVENTION

This invention primarily relates to tube shirts of the tank-top, T-shirt and sweat shirt variety and, more particularly, to a torso-covering tube garment capable of selectively fully-covering or partially-covering the lower torso of a wearer comprising, a torso-covering tube garment of a foldable material having a bottom portion covering a wearer's torso; and, fastening means for releasably holding a lower portion of the bottom portion against an upper portion of the bottom portion whereby a lower portion of the wearer's torso is exposed for ventilating.

T-shirts and sweat shirts are popular for everyday casual wear and for participating in sports. Basically, T-shirts and sweat shirts are of the same design with the difference being in the weight of the material used with T-shirts being of lighter weight than sweat shirts. Tank-tops are of similar construction except that the sleeves are omitted and replaced by over-the-shoulder straps. Thus, while both T-shirts and sweat shirts will be addressed in the descriptions of the prior art and the present invention which follow, it is to be understood that they are really interchangeable and that what can be done with one can be done with the other, or with a tank-top. For convenience only, therefore, only T-shirts will be addressed for the most part hereinafter.

The reason that T-shirts are popular particularly in warm weather is that they are light weight, absorb perspiration, protect against sunburn, protect against drafts after exercise when the body is hot and cooling down, and are easily washed. On the other hand, during particularly strenuous exercise in hot weather, even the lightest T-shirt material prevents air from reaching the body surface to assist in body cooling through evaporation. For this reason, the basic prior art T-shirt 10 of FIG. 1 has been modified in various ways to provide internal ventilation.

For example, in FIG. 2 the T-shirt 10 has had ventilation holes 12 added in the under-arm area. Carried a step further, the T-shirt 10' of FIG. 23 has the entire bottom portion 14 of a net material. The ultimate, of course, is the T-shirt 10'' of FIG. 6 which has the entire bottom portion 14 removed to form a "crop-top" shirt. While the shirts 10', 10'' provide a high degree of ventilation, they do nothing to stop the sun's rays and prevent sunburn. Moreover, they no longer stop drafts which can cause muscle cramping and other problems while the body is cooling off following exercise.

It should also be noted that the holes 12 of FIG. 2 and the net material of FIG. 3 are also employed in jackets and raincoats, particularly under a covering flap in the yoke portion of the garment so that the garment can "breath" while preventing rain from entering therethrough.

T-shirt shaped garments are also employed for other uses with access panels that can be opened and closed. For example, FIG. 4 depicts the back of a hospital gown 16 that has tie strips 18 for holding it together while FIG. 5 depicts a hospital gown 16' that has a side opening that can be held together with tie strips 18.

Examples of such prior art garments can be found in the following U.S. patents:

U.S. Pat. No. 4,728 showing ventilation holes in a garment.

U.S. Pat. No. 16,900 showing underarm venting.

U.S. Pat. No. 1,998,051 showing an operating robe for patients having opening embodiments but no securing means.

U.S. Pat. No. 2,497,764 showing a hospital bed gown with tie strips at the back.

U.S. Pat. No. 3,154,789 showing a disposable examination garment having fasteners for securing the sides together.

U.S. Pat. No. 4,277,848 showing a color changeable athletic jersey.

U.S. Pat. No. 4,608,715 showing a protective garment having variable ventilation entry and exit panels.

U.S. Pat. No. 5,060,315 showing a garment with one piece used for upper and/or lower body covering.

U.S. Pat. No. 5,133,086 showing a hospital gown with seamed opening and closing means.

The basic problem with these prior art garments is that they are meant to be used in one configuration. They may have access panels, ventilation holes, or the like; but, they are only used one way. What is needed is a garment that has one configuration for covering the user completely and another configuration providing maximum ventilation wherein there is a way to hold the garment in either configuration as desired.

Wherefore, it is an object of this invention to provide a torso-covering tube garment which can be worn in a covering configuration or a ventilating configuration.

It is another object of this invention to provide a torso-covering tube garment which can be worn with the bottom portion lowered to cover the torso of the wearer or worn with the bottom portion held in a raised position to expose the torso of the wearer.

It is yet another object of this invention to provide a torso-covering tube garment which can be converted from a covering configuration to a ventilating configuration without removal from the wearer.

It is still another object of this invention to provide a torso-covering tube garment which can be employed in a ventilating configuration during exercise and then converted to a covering configuration during a cool-down period of the body following the termination of the exercise.

It is a still further object of this invention to provide a torso-covering tube garment which is converted from a covering configuration to a ventilating configuration by overlapping a bottom portion upon itself to shorten it thereby to expose the lower portion of a wearer's torso.

Other objects and benefits of this invention will become apparent from the description which follows hereinafter when read in conjunction with the drawing figures which accompany it.

SUMMARY

The foregoing objects have been achieved by the torso-covering tube garment of the present invention capable of selectively fully-covering or partially-covering the lower torso of a wearer comprising, a torso-covering tube garment of a foldable material having a bottom portion moveable between a lowered position covering a wearer's torso and a raised position exposing the lower portion of the wearer's torso; and, releasable fastening means for releasably holding the bottom portion in the raised position.

In one embodiment, the fastening means comprises a pair of ties attached to the material at about one third of the bottom portion from a bottom edge thereof whereby when the pair of ties are pulled up and held the bottom portion folds over upon itself in thirds and exposes an outer surface of a bottom one third of the bottom portion. In one version, the pair of ties are long enough to fasten about the neck of a wearer.

In this embodiment a visible marking may be placed on the outer surface of the bottom one third of the bottom portion whereby the visible marking is visible when the lower portion of the bottom portion is held against the upper portion of the bottom portion.

Preferably, there are pouch means carried by the material for holding the pair of ties when the pair of ties are not in use.

In another embodiment, the fastening means comprises a pair of first portions of a touch fastener material attached to the material on an outer surface at about one third of the bottom portion from a bottom edge thereof; and, a pair of second mating portions of the touch fastener material attached to the material on an outer surface at about a top of the bottom portion whereby when the pair of first portions and the pair of second mating portions are respectively mated the bottom portion is folded over upon itself in thirds and exposes an outer surface of a bottom one third of the bottom portion.

As in the prior embodiment, a visible marking may be placed on the outer surface of the bottom one third of the bottom portion whereby the visible marking is visible when the lower portion of the bottom portion is held against the upper portion of the bottom portion.

In a third embodiment, the fastening means comprises a pair of first portions of a touch fastener material attached to the material on an outer surface at a bottom edge of the bottom portion; and, a pair of second mating portions of the touch fastener material attached to the material on an outer surface at about a top of the bottom portion whereby when the pair of first portions and the pair of second mating portions are respectively mated the bottom portion is folded over upon itself in half and exposes an inner surface of a bottom one half of the bottom portion.

In a fourth embodiment, the fastening means comprises an elastic strap attached to the material at a bottom edge of the bottom portion whereby when the elastic strap is pulled up, over the head, and around the neck of a wearer the bottom portion is folded over upon itself in half and held in the raised position.

In these latter embodiments, a visible marking may be placed on the inner surface of the bottom one half of the bottom portion whereby the visible marking is normally hidden and only visible when the lower portion of the bottom portion is held against the upper portion of the bottom portion.

In all the embodiments wherein the bottom portion is overlapped upon itself and fastened together with releasable fasteners of any kind, the fastener portions can be positioned on the front of the garment only, on the front and back, or along the side seams, as desired.

DESCRIPTION OF THE DRAWINGS

FIG. 1 is a drawing of a basic prior art T-shirt.

FIG. 2 is a drawing of a prior art T-shirt with ventilation holes.

FIG. 3 is a drawing of a prior art T-shirt with the bottom portion of a net material.

FIG. 4 is a drawing of the back of a back-opening hospital type gown.

FIG. 5 is a drawing of the front of a side-opening hospital type gown.

FIG. 6 is a drawing of a prior art T-shirt with the bottom portion removed to form a "crop-top" T-shirt.

DESCRIPTION OF THE PREFERRED EMBODIMENT

Figure 9:
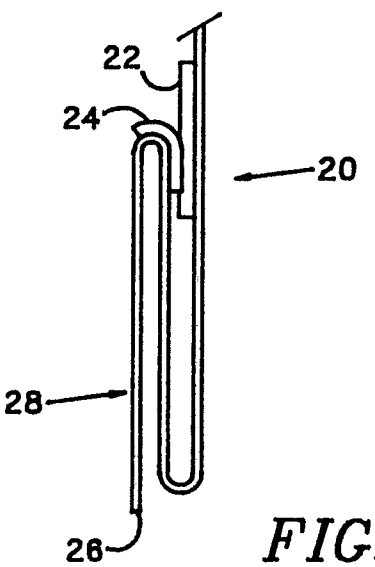
FIG. 9 is a cutaway drawing through the bottom portion of the T-shirt of FIG. 8.
Figure 8:
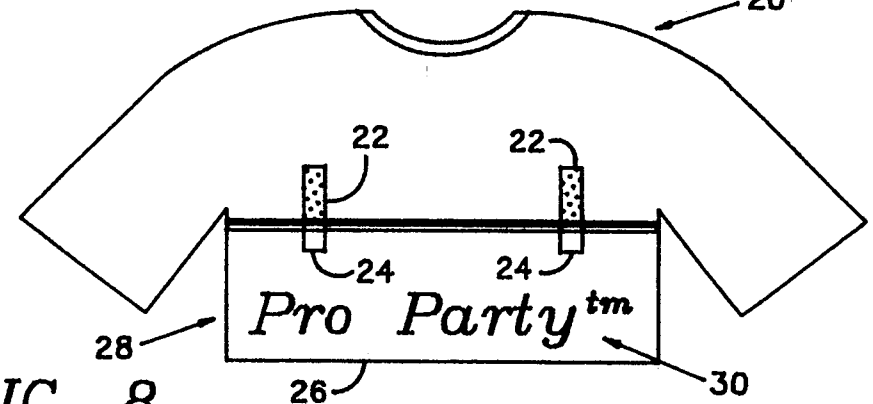
FIG. 8 is a front view of the T-shirt of FIG. 7 with the bottom portion in its raised position.
Figure 7:
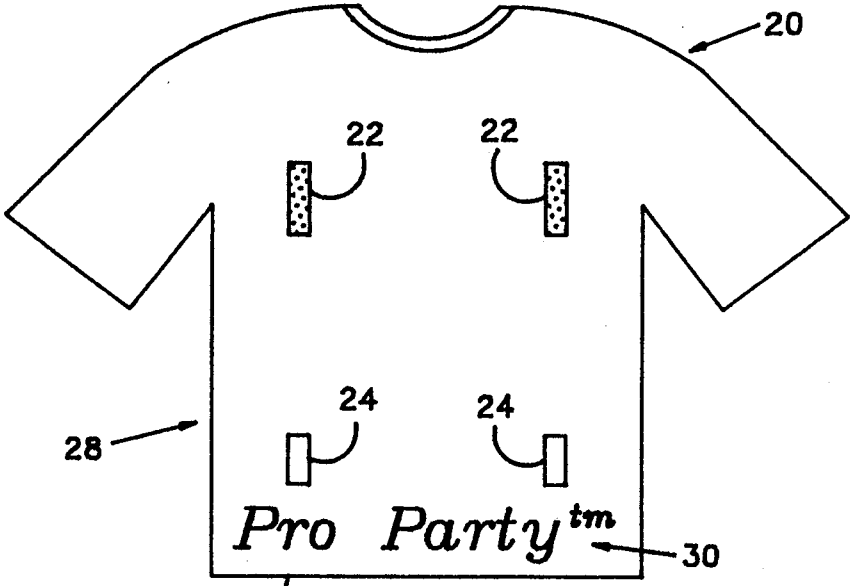
FIG. 7 is a front view of a T-shirt according to the present invention in a first embodiment with the bottom portion in its lowered position.

A T-shirt 20 according to the present invention in a first embodiment is shown in FIGS. 7–9. Tabs 22 of a first portion of a touch fastener material such as that sold under the tradename Velcro are attached to the material of the T-shirt 20 about the level of the sleeve bottoms as by sewing or adhesive attachment. Tabs 24 of the second mating portion of the touch fastener material are similarly attached to the material of the T-shirt 20 about one third up from the bottom hem 26. The tabs 22, 24 can be provided only on the front of the T-shirt 20 or, if desired for more even raising, to both the front and back. Of course, the tabs 22 could be placed higher or lower depending on how high the bottom is to expose the wearer's lower torso. Decorative flaps could also be placed over the tabs 22, if desired. For full torso covering, the T-shirt 20 is worn as in FIG. 7 with the bottom portion 28 fully lowered. For torso ventilation, the bottom portion 28 is folded over on itself in thirds as depicted in FIG. 9 and the tabs 22, 24 are pressed and mated together so that the T-shirt 20 appears as in FIG. 8.

As can be appreciated, the T-shirt 20 can be moved between its two configurations without removing it from the wearer. If the tabs 22, 24 are employed both front and back, assistance might be required to fasten the back tabs 22, 24 in the raised position of FIG. 8. The front tabs 22, 24 could, of course be engaged and the bottom portion 28 raised by a wearer alone even when running or jogging. And, a wearer can easily pull the bottom portion 28 down to the covering position of FIG. 7 whether front only or front and back tabs 22, 24 are employed.

T-shirts in particular are often provided with some advertising, logo, or message of particular interest to the wearer. By placing such material 30 on the lower one-third of the bottom portion 28, it is still visible when the T-shirt 20 is in its ventilating configuration as depicted in FIG. 8.

Figure 12:
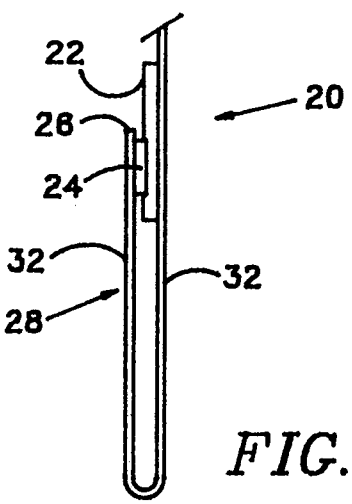
FIG. 12 is a cutaway drawing through the bottom portion of the T-shirt of FIG. 11.
Figure 11:
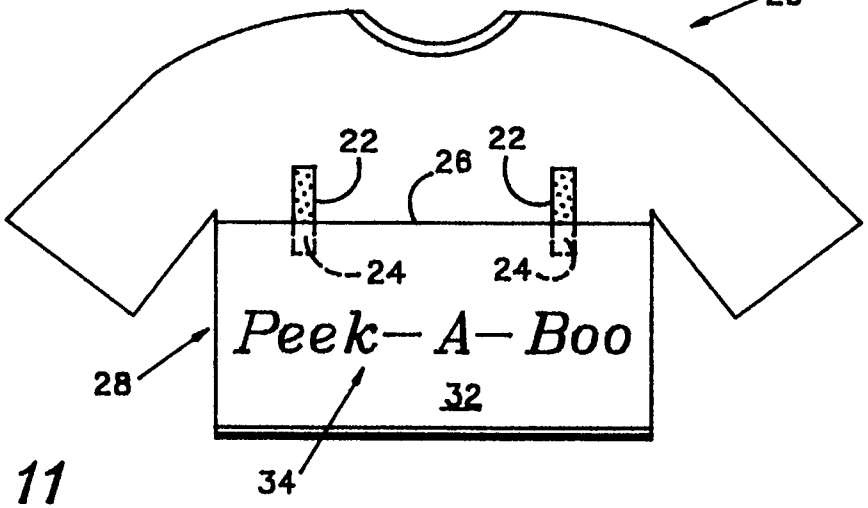
FIG. 11 is a front view of the T-shirt of FIG. 10 with the bottom portion in its raised position.
Figure 10:
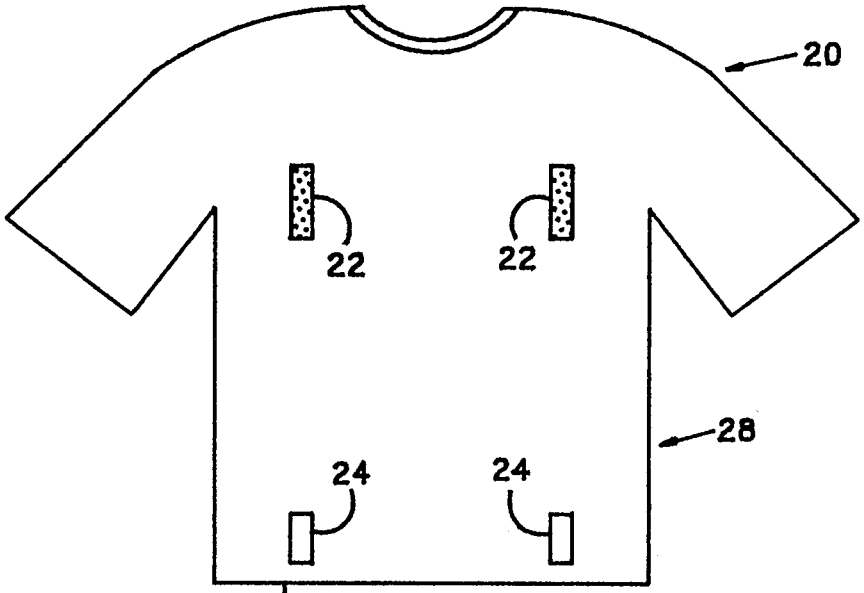
FIG. 10 is a front view of a T-shirt according to the present invention in a second embodiment with the bottom portion in its lowered position.

A second embodiment of the present invention appears in FIGS. 10–12. In this case, the tabs 22 are placed in approximately the same position; but, the tabs 24 are place adjacent the bottom hem 26. As in the prior embodiment, the tabs 22, 24 can be in the front alone or in both the front and the back of the T-shirt 20. As seen in FIG. 10, the lowered and fully covering position of this embodiment appears substantially the same as in the prior embodiment. In the ventilating position, however, the bottom portion 28 is only folded in half as best seen in FIG. 12. Thus, the inside surface 32 becomes what is seen. In this embodiment, a hidden message 34 can be attached to the inside surface 32 on the bottom half of the bottom portion 28. The hidden message 34, therefore, is only seen when the T-shirt 20 is in the ventilating configuration of FIG. 11.

As those of ordinary skill in the art will undoubtedly have recognized and appreciated from the foregoing description of the first two embodiments of the present invention, the touch fastener material tabs 22, 24 could be replaced by any pair of releasable fasteners including tie strips, hooks and eyes, snaps, or the like. Touch fastener material is preferred for these embodiments simply because it is easy to use even when running or jogging.

Figure 13:
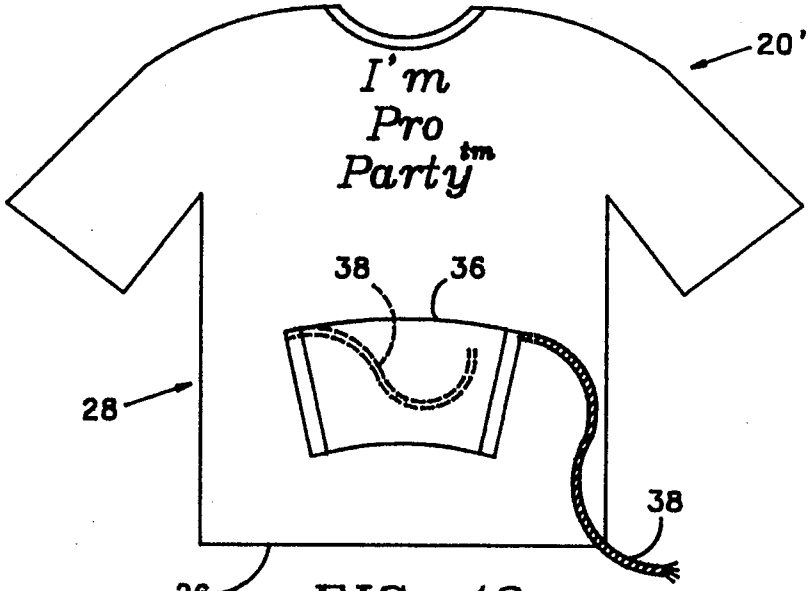
FIG. 13 is a front view of a sweat shirt according to the present invention in a third embodiment with the bottom portion in its lowered position.
Figure 15:
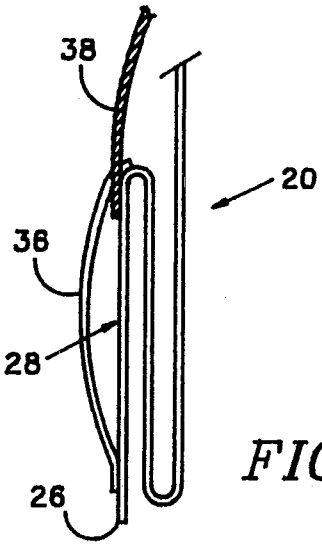
FIG. 15 is a cutaway drawing through the bottom portion of the sweat shirt of FIG. 14.
Figure 14:
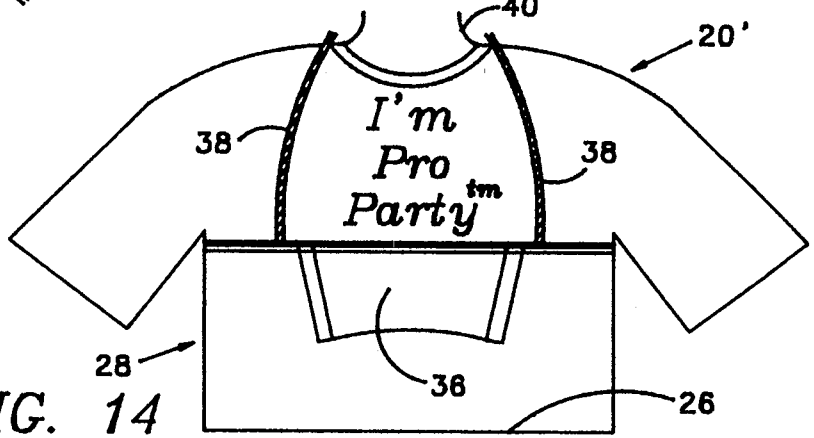
FIG. 14 is a front view of the sweat shirt of FIG. 13 with the bottom portion in its raised position.

A third embodiment employing tie cords as the preferred fastening system is depicted in FIGS. 13–15. The T-shirt 20' is of the type most commonly found of sweat shirt material having a pouch pocket 36 on the front towards the bottom of the bottom portion 28. A pair of tie cords 38 are attached to the top of the pouch pocket 36 on one end. The tie cords 38 can then be stuffed into the pouch pocket 36 when the T-shirt 20' is in its lowered configuration of FIG. 13. To place the T-shirt 20' into its ventilating configuration, the tie cords 38 are pulled up, fastened around the neck 40 of the wearer, and tied in back as depicted in FIGS. 14 and 15. Of course, a wearer may wish to pre-tie the tie cords 38 before starting out so that the pre-tied loop of tie cords 38 can simply be slipped over the wearer's head to lift the bottom portion. 28 at a desired time without having to worry about tying a knot in the tie cords 38.

Note that the bottom portion 28 is folded upon itself in thirds in this embodiment: as was the case with the first embodiment described above. While employing the pouch pocket 36 (or a similar pocket) to store the tie cords 38 when not in use is preferred, the tie cords 38 could, of course, be used alone by simply attaching one end to the material of the T-shirt 20' at appropriate points. The free ends of the tie cords 38 could also be fastened to points on the material of the T-shirt 20' rather than around the neck of the wearer, if desired.

Figure 16:
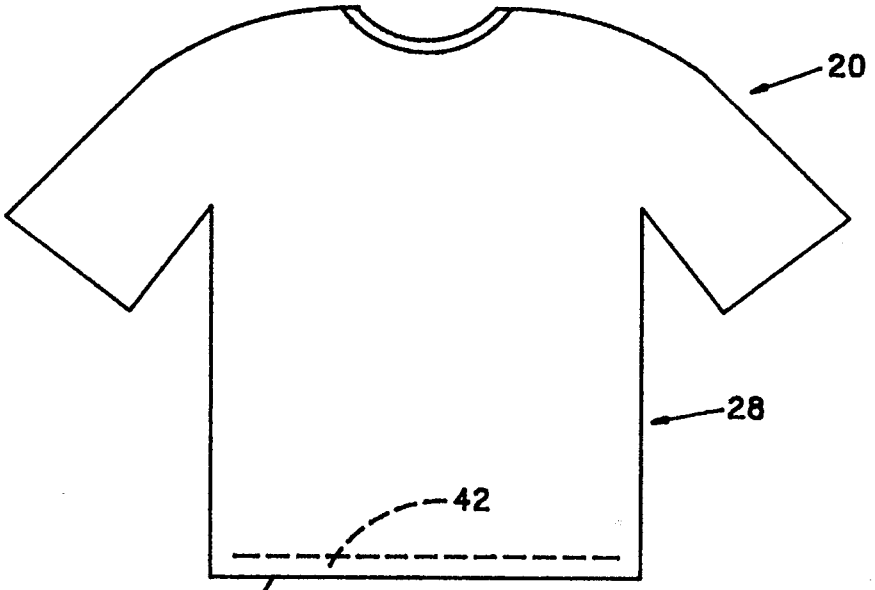
FIG. 16 is a front view of a sweat shirt according to the present invention in a fourth embodiment with the bottom portion in its lowered position.
Figure 17:
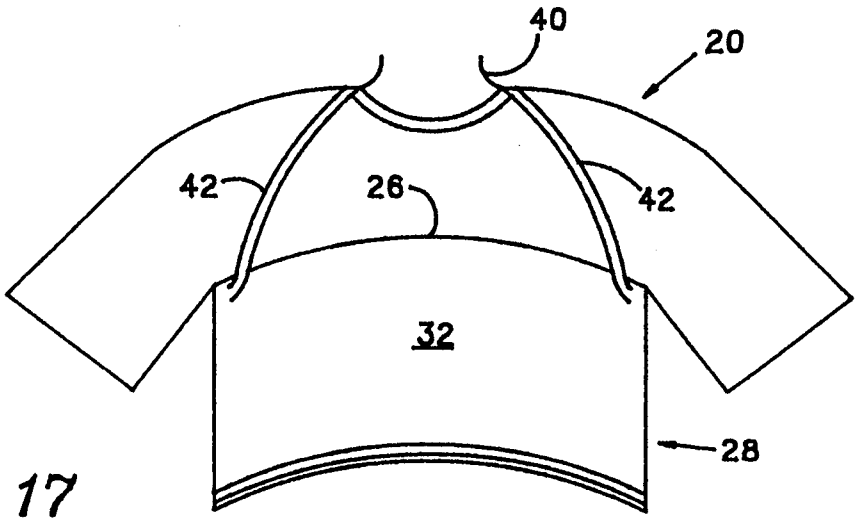
FIG. 17 is a front view of the sweat shirt of FIG. 16 with the bottom portion in its raised position.

A fourth embodiment of the present invention is shown in FIGS. 16 and 17. This embodiment is a cross between that of FIGS. 10–12 and FIGS. 13–15 in that the bottom portion 28 is folded over on itself in half as in the embodiment of FIGS. 10–12 while using an around-the-neck tying system as in the embodiment of FIGS. 13–15. In this embodiment, an elastic strap 42 is fastened at its ends to the material of the bottom strap 42 can be on the inside or the outside with the inside being preferred for esthetic reasons only. To raise the bottom portion 28 from its lowered position of FIG. 16 to its raised position of FIG. 17, the wearer simply has to reach in, grasp the elastic strap 42, and slip it over his/her head.

Figure 18:
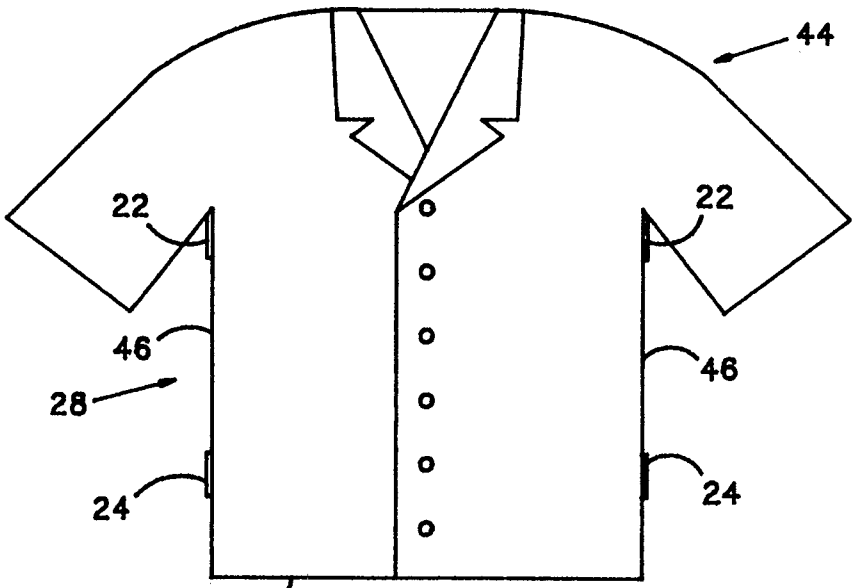
FIG. 18 is a front view of a tubular shirt which buttons down the front according to the present invention showing how the fastener portions can be positioned along the side seams if desired.
Figure 19:
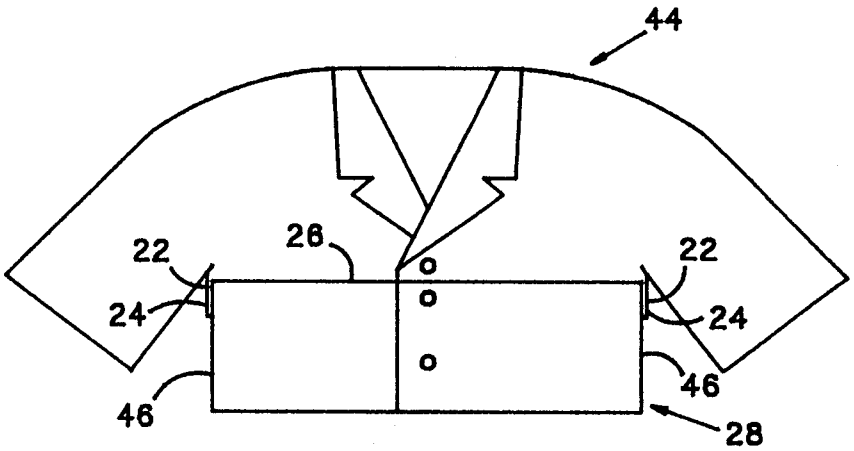
FIG. 19 is a front view of the shirt of FIG. 18 with the bottom portion in its raised position.

Two other aspects of the present invention are depicted in FIGS. 18 and 19. As those of ordinary skill in the art will undoubted have realized by this point, while T-shirts, tank-tops, and sweat shirts are the primary garment of interest with respect to the present invention, there are other torso-covering garments which can also fall into this "tubular garment" category and may benefit from the present invention in certain circumstances. For example, the loose-fitting aloha shirt 44 while it buttons up the front and can be unbuttoned, is a tubular garment when it is buttoned. Thus, for cooling, one might prefer to have the bottom foreshortened as in FIG. 19 according to the present invention rather than undoing the buttons to have the shirt front flapping in the breeze and exposing the wearer's entire chest. This would be particularly true in the case of women wearers who might prefer to go braless in hot weather. The present invention of FIG. 19 would allow cooling while preserving modest in such situations.

As also pictured in FIGS. 18 and 19, with such garments it might be preferred to have the securing fasteners located along the side seams 46 of the garment. As depicted in FIGS. 18 and 19, the bottom portion 28 of the shirt 44 is intended to be folded over upon itself in thirds with the outer surface of the bottom portion 28 remaining visible. For this purpose, the tabs 22 of the touch fastener material are positioned on the side seams 46 just under the sleeve bottoms while the tabs 24 are positioned about one-third of the way up from the bottom hem 26.

Thus, it can be seen from the foregoing description and accompanying drawings that the present invention has truly met is stated objectives by providing several different embodiments of torso-covering tubular shirts that can be worn selectively in a lowered and covering configuration or in a raised and ventilating configuration. Further variations of the present invention within the scope and spirit of this disclosure should also become apparent to those of ordinary skill in the art and are to be included within the scope of the claims which follow hereinafter.

Wherefore, having thus described the present invention, what is claimed is:

1. A torso-covering tube garment capable of selectively fully-covering or partially-cowering the lower torso of a wearer comprising:

a) a torso-covering tube garment of a foldable material having a bottom portion covering a wearer's torso; and, b) fastening means for releasably holding a tubular lower portion of said bottom portion circumferentially against a tubular upper portion of said bottom portion whereby a lower portion of said wearer's torso is exposed for ventilating; and wherein said fastening means comprises, c) a pair of ties attached to said material at about one third of said bottom portion from a bottom edge thereof and positioned so that when said pair of ties are pulled up and held said bottom portion circumferentially folds over upon itself in thirds and exposes an outer surface of a bottom one third of said bottom portion.

2. The torso-covering tube garment of claim 1 wherein:

said pair of ties are long enough to fasten about the neck of a wearer.

3. A torso-covering tube garment capable of selectively fully-covering or partially-covering the lower torso of a wearer and of displaying a message when partially-covering the lower torso of the wearer comprising:

a) a torso-covering tube garment of a foldable material having a bottom portion moveable between a lowered position covering a wearer's torso and a raised position exposing the lower portion of said wearer's torso, said material carrying a message thereon; and, b) releasable fastening means for releasably holding entire tubular lower portion of said bottom portion in said raised position.

4. The torso-covering tube garment of claim 3 wherein:

a) said bottom portion circumferentially folds over upon itself in thirds and exposes an outer surface of a bottom one third of said bottom portion when in said raised position; and, b) said message is on said outer surface of said bottom one third of said bottom portion and positioned so that said message is visible when said bottom portion is in both said raised position and said lowered position.

5. The torso-covering tube garment of claim 3 wherein:

a) said bottom portion circumferentially folds over upon itself in half and exposes an inner surface of a bottom one half of said bottom portion when in said raised position; and, b) said message is on said inner surface of said bottom one half of said bottom portion and positioned so that said message is a hidden message only visible when said bottom portion is in said raised position.

6. A torso-covering tube garment capable of selectively fully-covering or partially-covering the lower torso of a wearer comprising:

a) a torso-covering tube garment of a foldable material having a bottom portion covering a wearer's torso; and, b) fastening means for releasably holding a tubular lower portion of said bottom portion circumferentially against a tubular upper portion of said bottom portion whereby a lower portion of said wearer's torso is exposed for ventilating; and wherein said fastening means comprises, c) a pair of first portions of a touch fastener material attached to said material on an outer surface at about one third of said bottom portion from a bottom edge thereof; and, d) a pair of second mating portions of said touch fastener material attached to said material on an outer surface at about a top of said bottom portion and positioned so that when said pair of first portions and said pair of second mating portions are respectively mated said bottom portion is circumferentially folded over upon itself in thirds and exposes an outer surface of a bottom one third of said bottom portion.

7. The torso-covering tube garment of claim 6 and additionally comprising:

pouch means carried by said material for holding said pair of ties when said pair of ties are not in use.

8. A torso-covering tube garment capable of selectively fully-covering or partially-covering the lower torso of a wearer comprising:

a) a torso-covering tube garment of a foldable material having a bottom portion covering a wearer's torso; and, b) fastening means for releasably holding a tubular lower portion of said bottom portion circumferentially against a tubular upper portion of said bottom portion whereby a lower portion of said wearer's torso is exposed for ventilating; and wherein said fastening means comprises, c) a pair of first portions of a touch fastener material attached to said material on an outer surface at a bottom edge of said bottom portion; and, d) a pair of second mating portions of said touch fastener material attached to said material on an outer surface at about a top of said bottom portion and positioned so that when said pair of first portions and said pair of second mating portions are respectively mated said bottom portion is circumferentially folded over upon itself in half and exposes an inner surface of a bottom one half of said bottom portion.

9. The torso-covering tube garment of claim 8 and additionally comprising:

a visible marking on said outer surface of said bottom one third of said bottom portion and positioned so that said visible marking is visible both when said lower portion of said bottom portion is held against said upper portion of said bottom portion and when it is not.

10. A torso-covering tube garment capable of selectively fully-covering or partially-covering the lower torso of a wearer comprising:

a) a torso-covering tube garment of a foldable material having a bottom portion covering a wearer's torso; and, b) fastening means for releasably holding a tubular lower portion of said bottom portion circumferentially against a tubular upper portion of said bottom portion whereby a lower portion of said wearer's torso is exposed for ventilating; and wherein said fastening means comprises, c) an elastic strap attached to said material at a bottom edge of said bottom portion and positioned so that when said elastic strap is pulled up, over the head, and around the neck of a wearer said bottom portion is circumferentially folded over upon itself in half and held in said raised position.

11. The torso-covering tube garment of claim 10 and additionally comprising:

a visible marking on said inner surface of said bottom one half of said bottom portion and positioned so that said visible marking is only visible when said lower portion of said bottom portion is held against said upper portion of said bottom portion.

* * * * *